US005501612A

United States Patent [19]

Green

[11] Patent Number: 5,501,612

[45] Date of Patent: Mar. 26, 1996

[54] LOW PROFILE BOARD-TO-BOARD ELECTRICAL CONNECTOR

[75] Inventor: Eric T. Green, Hummelstown, Pa.

[73] Assignee: The Whitaker Corporation, Wilmington, Del.

[21] Appl. No.: 261,599

[22] Filed: Jun. 17, 1994

[51] Int. Cl.[6] ..... H01R 9/07

[52] U.S. Cl. ..... 439/499; 439/936

[58] Field of Search ..... 439/79, 80, 67, 439/77, 493, 936, 499, 492, 494; 29/841

[56] References Cited

U.S. PATENT DOCUMENTS

| | | | |
|---|---|---|---|
| Re. 33,604 | 6/1991 | Gillett et al. | 439/62 |
| 3,614,707 | 10/1971 | Kaufmann et al. | 339/17 F |
| 3,922,054 | 11/1975 | Dechelette | 339/75 MP |
| 4,077,694 | 3/1978 | Cobaugh et al. | 339/176 MP |
| 4,335,932 | 6/1982 | Herrmann, Jr. | 339/218 M |
| 4,717,345 | 1/1988 | Gordon et al. | 439/67 |
| 4,729,743 | 3/1988 | Farrar et al. | 439/276 |
| 4,749,356 | 6/1988 | Asai et al. | 439/67 |
| 4,755,147 | 7/1988 | Young | 439/77 |
| 4,826,451 | 5/1989 | Cunningham | 439/936 |
| 4,861,272 | 8/1989 | Clark | 439/77 |
| 4,895,523 | 1/1990 | Morrison et al. | 439/67 |
| 4,907,975 | 3/1990 | Dranchak et al. | 439/67 |
| 4,911,643 | 3/1990 | Perry et al. | 439/67 |
| 4,935,454 | 6/1990 | Koblitz et al. | 439/936 |
| 5,030,113 | 7/1991 | Wilson | 439/80 |
| 5,049,087 | 9/1991 | Chung et al. | 439/259 |
| 5,065,506 | 11/1991 | Kiribayashi | 29/832 |
| 5,161,986 | 11/1992 | Gulbranson et al. | 439/92 |
| 5,163,835 | 11/1992 | Morlion et al. | 439/67 |
| 5,197,888 | 3/1993 | Brodsky et al. | 439/67 |
| 5,227,955 | 7/1993 | LeBris | 439/76 |
| 5,348,488 | 9/1994 | Green et al. | 439/140 |
| 5,409,384 | 4/1995 | Green et al. | 439/67 |

*Primary Examiner*—Neil Abrams
*Attorney, Agent, or Firm*—Anton P. Ness

[57] ABSTRACT

A connector (10) for interconnecting a daughter card to a mother board using a flexible circuit element (64) joining the connector contacts (54) to the daughter card traces (76), while pin sections (56) of the contacts depend from the connector for insertion into mother board through-holes. A plate (82) of dielectric material is placed atop the terminations of the flexible circuit element to the contacts, with plate apertures (86) receiving the upper contact sections (66) and solder terminations thereinto, with potting compound (98) then placed in the apertures embedding and sealing the terminations, whereafter the plate provides enhanced strain relief.

5 Claims, 6 Drawing Sheets

LOW PROFILE BOARD-TO-BOARD ELECTRICAL CONNECTOR

FIELD OF THE INVENTION

The present invention is related to electrical connectors and more particularly to connectors adapted to interconnect a daughter card to a mother board.

BACKGROUND OF THE INVENTION

Certain electrical connectors contain an array of electrical contacts having pin sections coextending from a mounting face of the connector to be received into respective through-holes of a circuit element such as a mother board to become electrically connected with circuits of the board. The dielectric housing of the connector includes passageways in which the contacts are respectively retained in selected spacings and positions so that the pin sections coextend in a selected pattern. Such connectors are adapted to be affixed to edges of daughter cards on an opposed or second face of the connector, with the contacts including other contact sections electrically connected to circuits on major surfaces of the daughter card proximate the edge thereof. Many such connectors are of the type including a card-receiving recess thereinto, with the other contact sections disposed along sides of the recess to enter biased engagement with the corresponding card traces, all permitting withdrawal of the card therefrom during unmating. For example, see U.S. Pat. No. 4,077,694.

In U.S. Pat. Nos. 5,409,384 and 5,348,488, is disclosed a connector utilizing an element of flexible film circuitry for electrical interconnection of contacts of the daughter card to contacts of the connector. The dielectric housing has a thin substantially planar body section defining a board-proximate face and a board-remote face, an array of contact members including pin sections coextending from the board-proximate face of the body section to be received into corresponding through-holes of a mother board, and short second pin sections coextending from the board-remote face. The flexible circuit element includes defined thereon an array of circuits extending from termini located in a first interconnecting region associated with the second pin sections in a complementary pattern, along at least one side portion of the element formed upwardly from sides of the housing to contact sections exposed in at least one second interconnection region and associated with an array of circuits disposed on a surface of a daughter card to be interconnected therewith.

The termini include pin-receiving apertures therethrough, so that when the flexible circuit element is properly oriented and its first interconnecting region pressed against the array of second pin sections of the connector contacts, the second pin sections enter through the pin-receiving apertures. With the traces and trace termini defined on the housing-remote surface of the flexible circuit element, the second pin sections protruding above the associated termini can easily be soldered thereto to establish the electrical connections. The side portion or portions of the flexible circuit element is or are then formed upwardly. Potting material is then deposited atop the first interconnecting region to a selected thickness, embedding and sealing and protecting the electrical connections, and also providing a mechanical retention of the flexible circuit element to the connector housing.

In one embodiment of connector disclosed in U.S. Pat. No. 5,409,384, the flexible circuit element includes opposing side portions upwardly formed for second interconnecting regions on each to oppose each other and define a card-receiving region therebetween, into which an edge of a card is inserted for the traces on both surfaces to be soldered to exposed trace sections of the flexible circuit element. In another embodiment for a connector with fewer contacts, one such side portion and second interconnecting region extends upwardly to be secured to a corresponding surface of a daughter card and the exposed traces soldered to respective traces on that surface. The connectors provide a low profile board-to-board connector adapted for use in very confined spaces especially in a closely spaced array, wherein the electrical connections of the flexible film circuitry to contacts of the connector are sealed for long-term in-service life.

SUMMARY OF THE INVENTION

The present invention provides a low profile board-to-board connector that incorporates a flexible film circuit element for connecting traces of a daughter card to contacts of the connector which contacts include pin sections for interconnecting to circuits of a mother board at through-holes thereof. A premolded dielectric plate is provided above the array of solder joints of the flexible circuit element traces to the connector contacts. An array of holes corresponding to the sites of the soldered electrical connections permits potting compound to be disposed in the holes around the solder joints embedding and sealing the electrical connections. Control of the flow of potting compound results, with a defined boundary to the potted board-remote interface. The plate may be adhered to the surface of the flexible film circuit element prior to potting, if desired, and the plate thus adhered and potted provides strain relief benefits.

An embodiment of the present invention will now be described by way of example with reference to the accompanying drawings.

DETAILED DESCRIPTION OF THE PREFERRED EMBODIMENT

Figure 1:
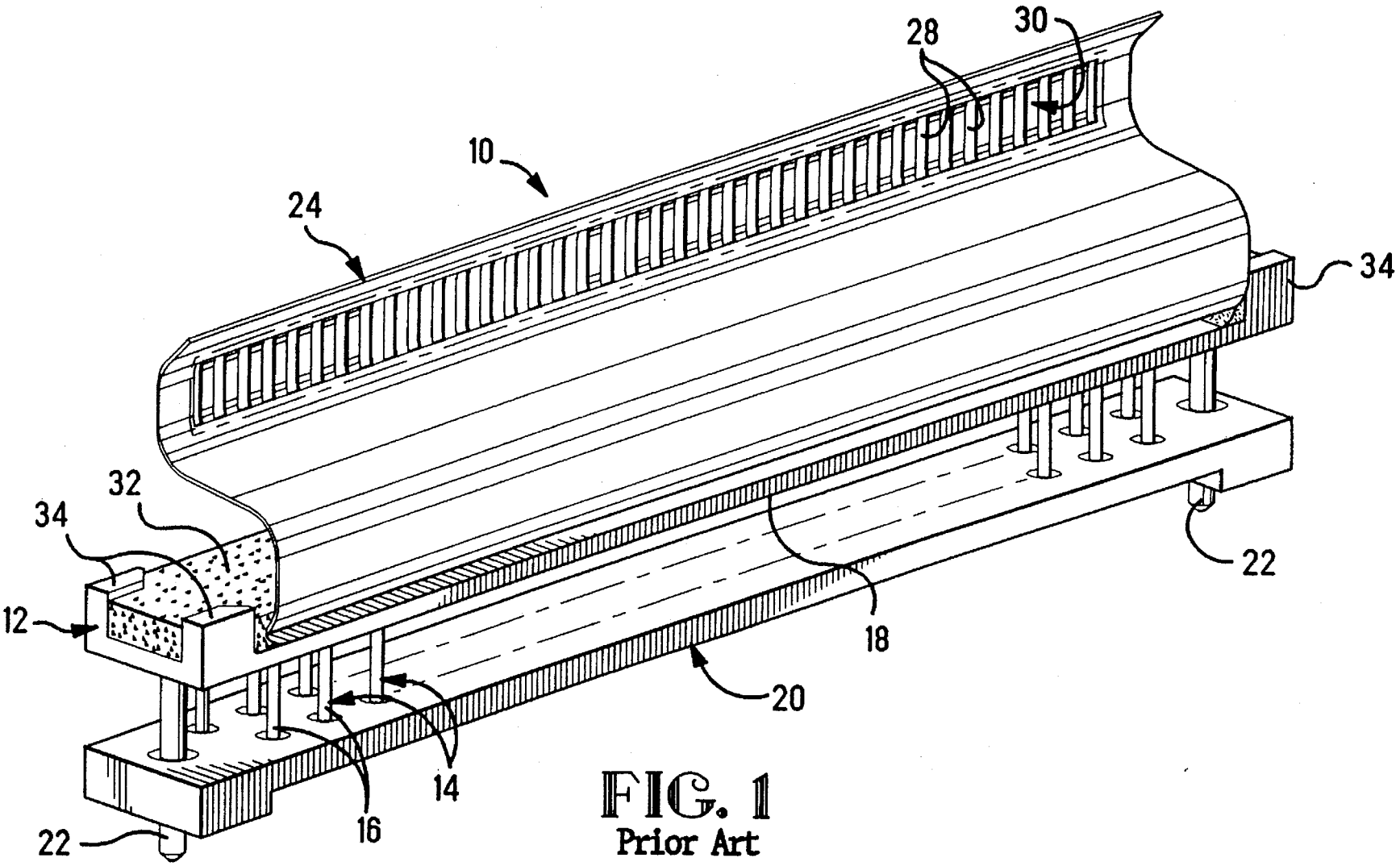
FIG. 1 Prior Art
FIG. 1 is an isometric view of a PRIOR ART connector having a flexible circuit element electrically connected to contacts of the connector, wherein the electrical connections along the top connector surface are embedded in a layer of potting compound of selected depth.

FIG. 1 illustrates a connector of the prior art, such as that disclosed in U.S. Pat. Nos. 5,409,384 and 5,348,488. Connector assembly 10 includes a dielectric housing 12 with an array of contacts 14 affixed thereto in two rows, having pin sections 16 depending from a board mounting face 18 of housing 12 for eventual insertion into through-holes of a mother board (not shown). An organizer or alignment plate 20 is shown disposed below the housing and along free ends of the contact pins sections and the guide posts 22 at each end of the array, for maintaining the pin sections aligned to facilitate board mounting, with the organizer movable along the pin sections toward and to the housing during board mounting. Flexible film circuit element 24 includes circuits electrically connected to upper sections of contacts 14 at a first interconnection region 26, and the circuits extend to exposed portions 28 at a second interconnection region 30 for eventual electrical connections to corresponding traces of a daughter card (not shown). Potting compound 32 is shown applied to the upper face of the connector to a selected depth embedding the electrical connections of the traces to the connector contacts and also upper ends of guide posts 22. Embossments 34 are disposed at each corner of the upper face of the connector housing, serving to provide housing surface to which the potting compound is adhered to enhance the bond.

Figure 7:
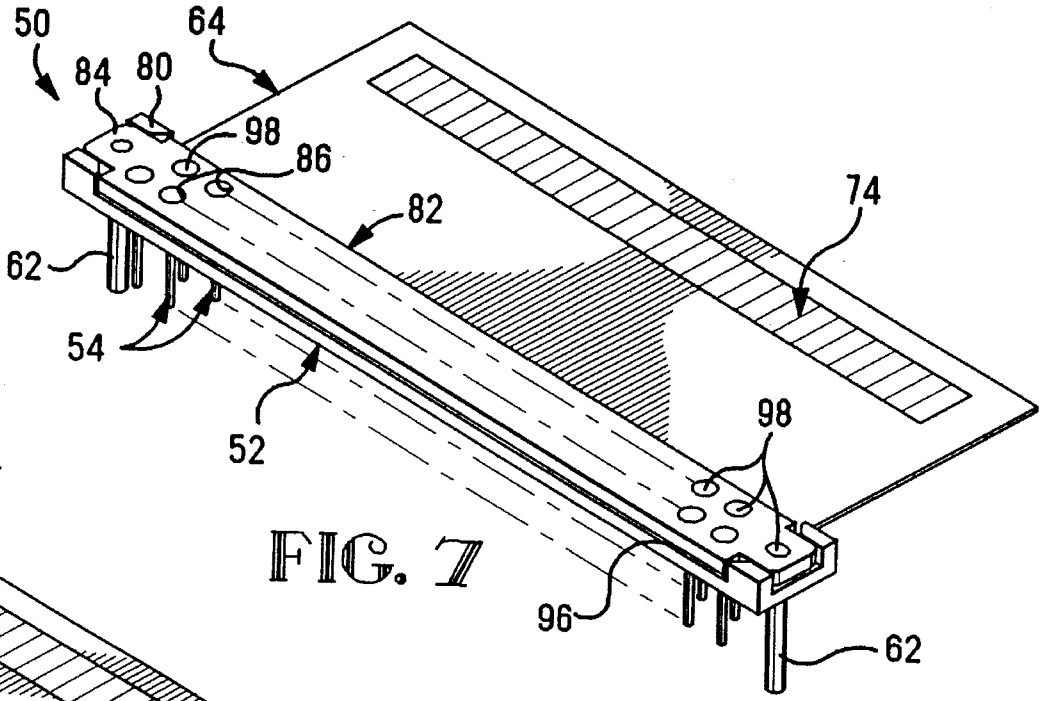
Figure 8:
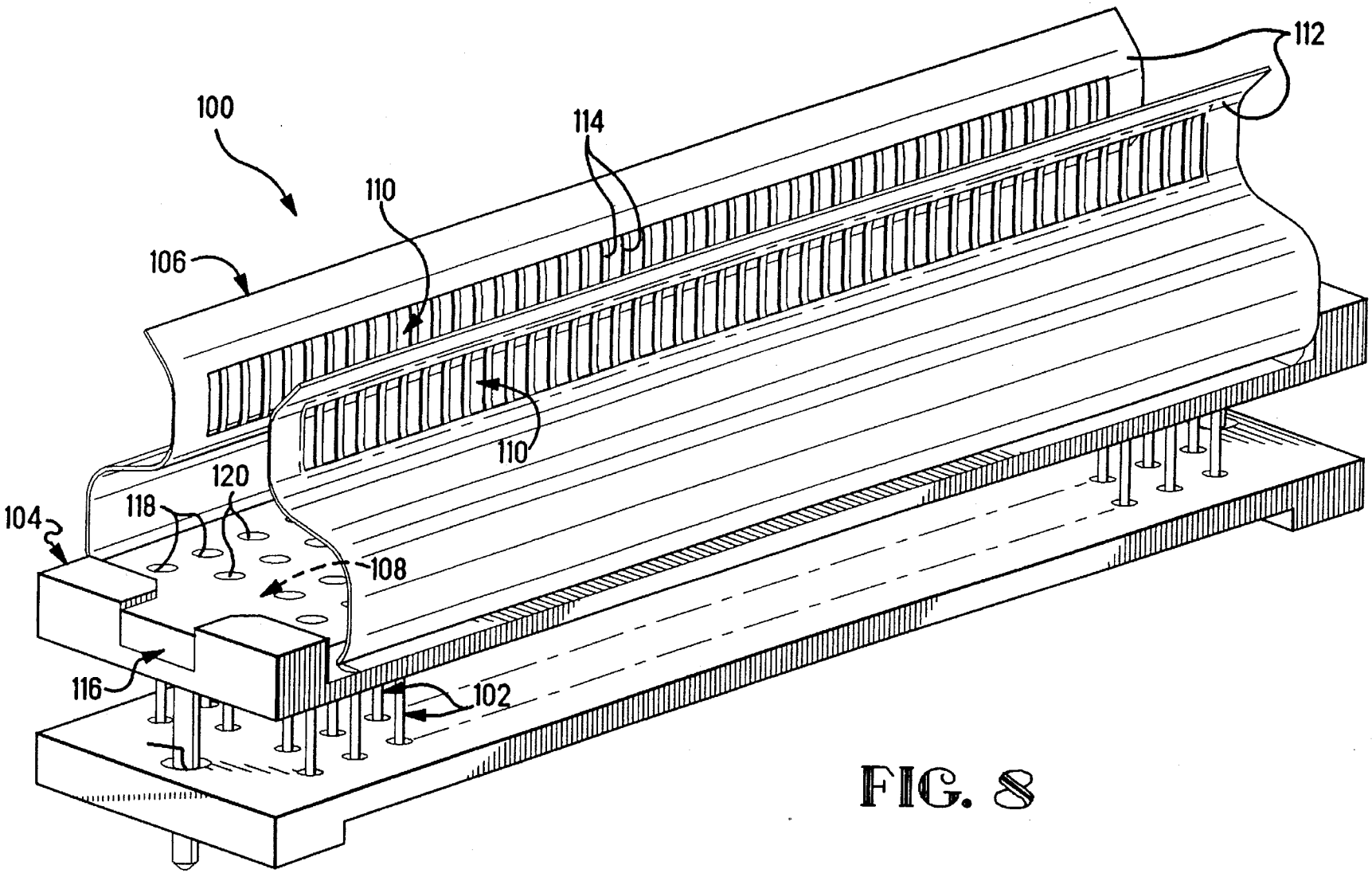
FIG. 8 illustrates an alternate embodiment having four rows of connector contacts and a corresponding flexible circuit element having two opposed daughter card interconnection regions.

The present invention is illustrated in FIGS. 2 to 7 with an alternate embodiment shown in FIG. 8. Connector 50 is configured to be similar to connector 10 of FIG. 1 in most ways. A dielectric housing 52 includes an array of contacts 54 affixed thereto in two rows, having pin sections 56 depending from a board mounting face 58 for eventual insertion into through-holes of a mother board (not shown). An alignment plate 60 of dielectric material is shown disposed below the housing and along free ends of the contact pins sections and the guide posts 62 at each end of the array, for maintaining the pin sections aligned to facilitate board mounting, with the plate movable along the pin sections toward and to the housing during board mounting. Flexible film circuit element 64 includes circuits electrically connected to upper sections 66 of contacts 54 by soldering at a first interconnection region 68 along upper or card-proximate face 70, and the circuits extend to exposed portions 72 at a second interconnection region 74 for eventual electrical connections to corresponding traces 76 of a daughter card 78. Embossments 80 are disposed at each corner of the upper face of the connector housing.

In accordance with the present invention, a plate 82 of dielectric material is utilized to traverse the card-proximate face 70 of the connector atop the upper surface of first interconnection region 68 of flexible circuit element 64. End flanges 84 are disposed between each pair of embossments 80 at each end of the connector. Holes 86 extend through plate 82 at each location of a solder connection between an upper contact section 66 and a circuit trace, and also at the upper end 88 of each guide post 62. Potting compound 98 is disposed in each hole 86 to embed and thus seal each electrical connection therein.

Figure 2:
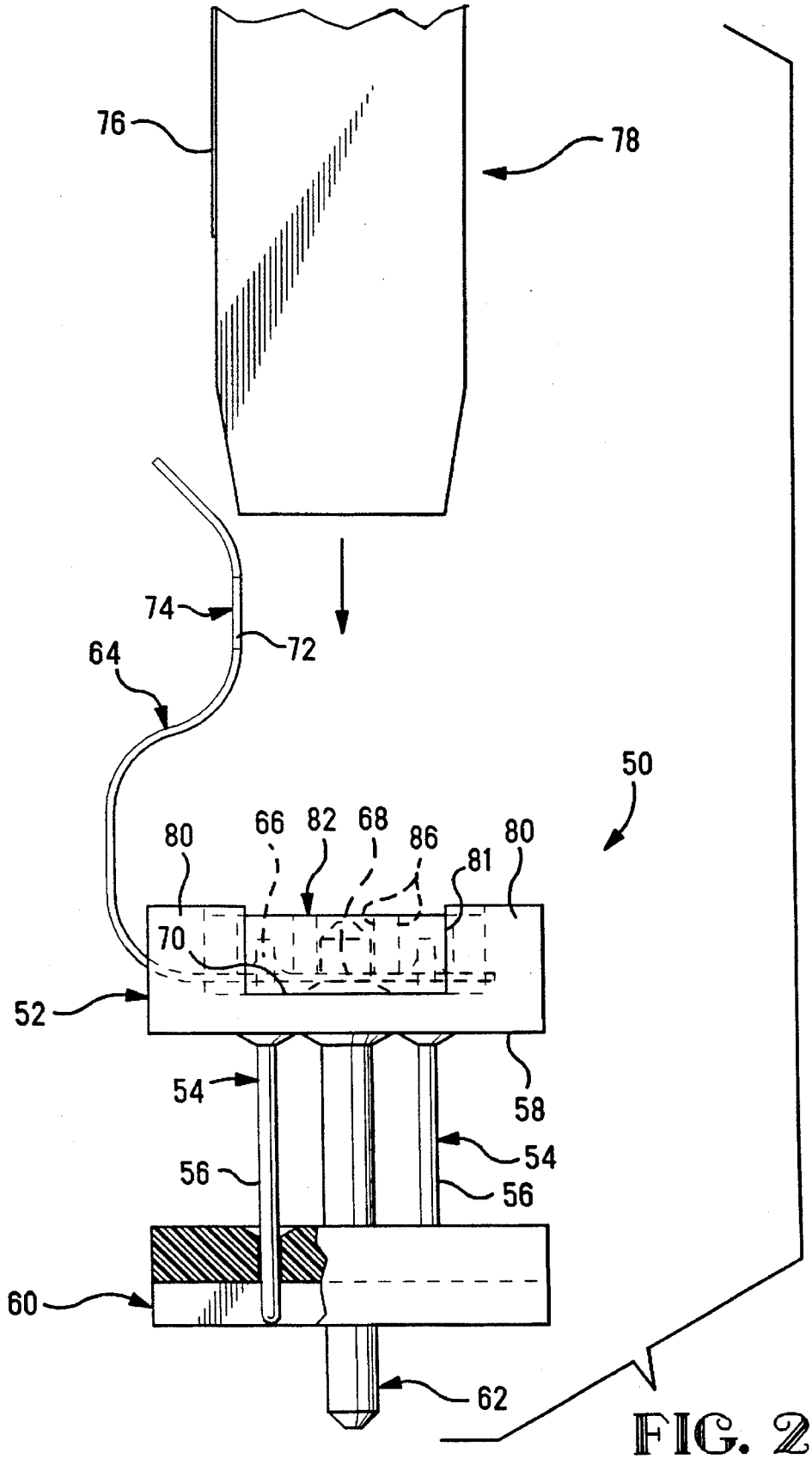
FIG. 2 is an elevation view of the connector of the present invention having a portion of a flexible circuit element extending for eventual interconnection of its traces to those of a daughter card, and the connector including a dielectric plate surrounding the upper ends of a guide post and the contacts soldered to the film's circuits.
Figure 3:
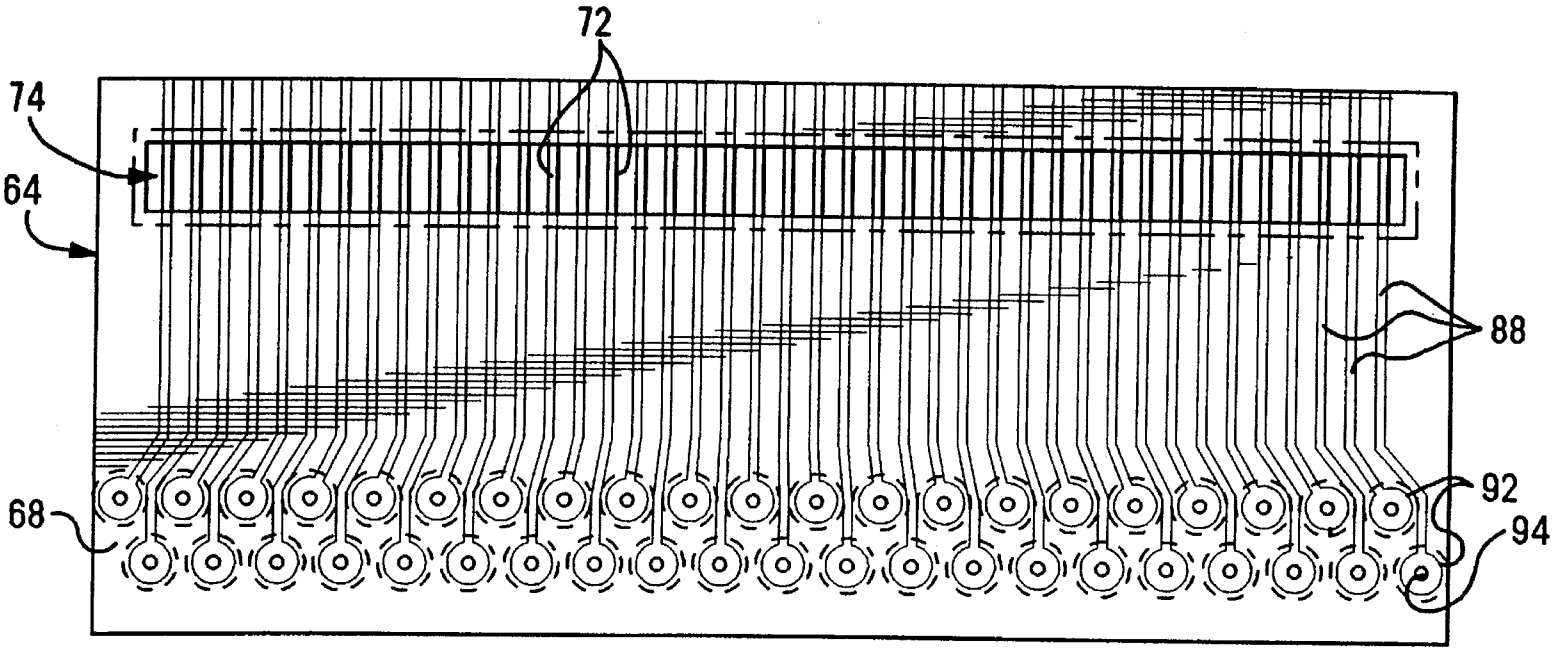
FIG. 3 is a plan view of the flexible circuit element of FIG. 2.
Figure 4:
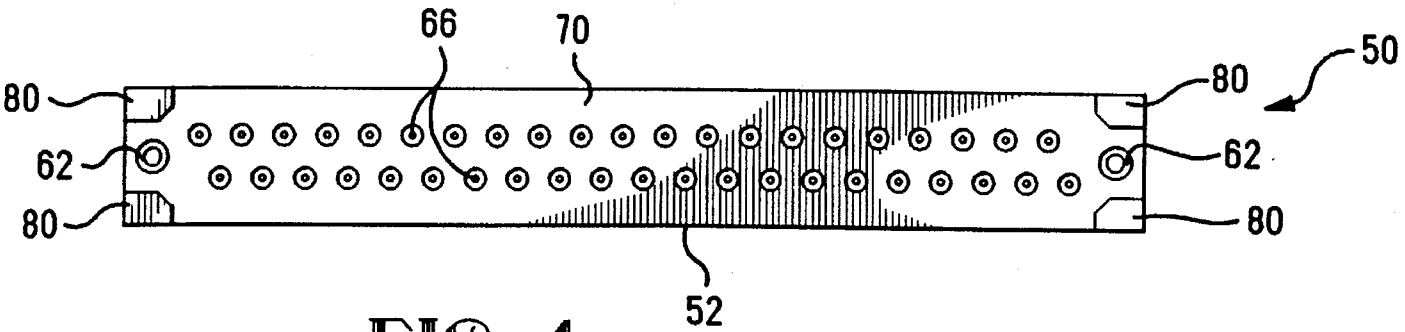
FIG. 4 is a plan view of the connector of FIG. 2 prior to affixing thereto the flexible circuit element, illustrating the upper contact sections of the connector.

The pattern of traces of an example flexible circuit element 64 is seen in FIG. 3, and at first interconnection region 68 each trace 90 includes an annular ring 92 surrounding a pin-receiving aperture 94 at each site of an upper contact section of the connector, for soldering thereto, and also an exposed portion 72 at second interconnection region 74 for eventual connection with a trace 76 of a daughter card 78 (FIG. 2). Upper or card-proximate connector face 70 of connector 50 is shown in FIG. 4 showing upper contact sections 66 and upper ends of guide posts 62.

Figure 5:
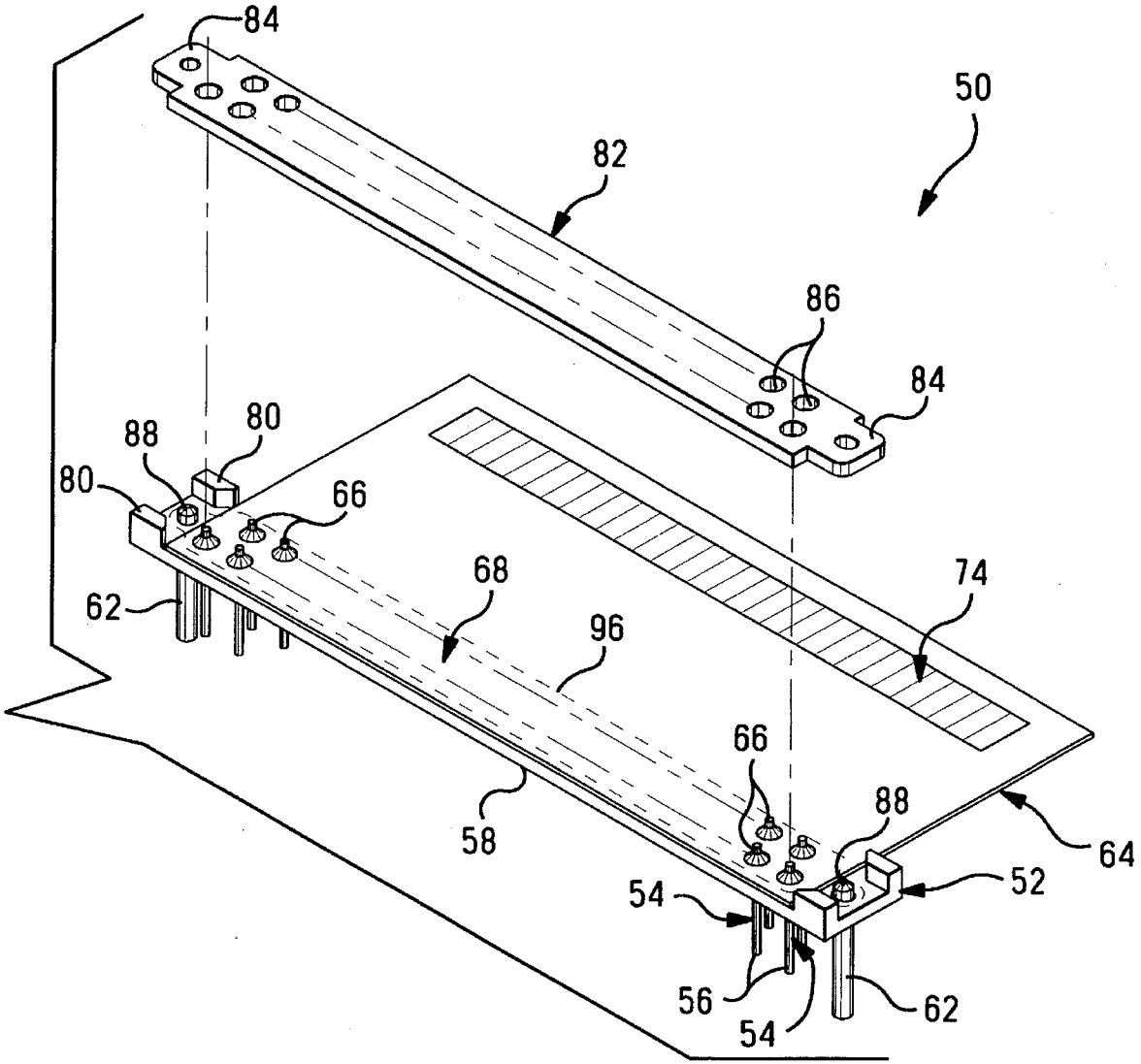
FIGS. 5 to 7 show the method of assembling the connector of FIGS. 2 to 4, by placement of the flexible circuit element and soldering of its traces to the connector contacts, placement of the plate thereonto, and placement of potting compound in the plate holes embedding the solder joints and the guide post ends.
Figure 6:
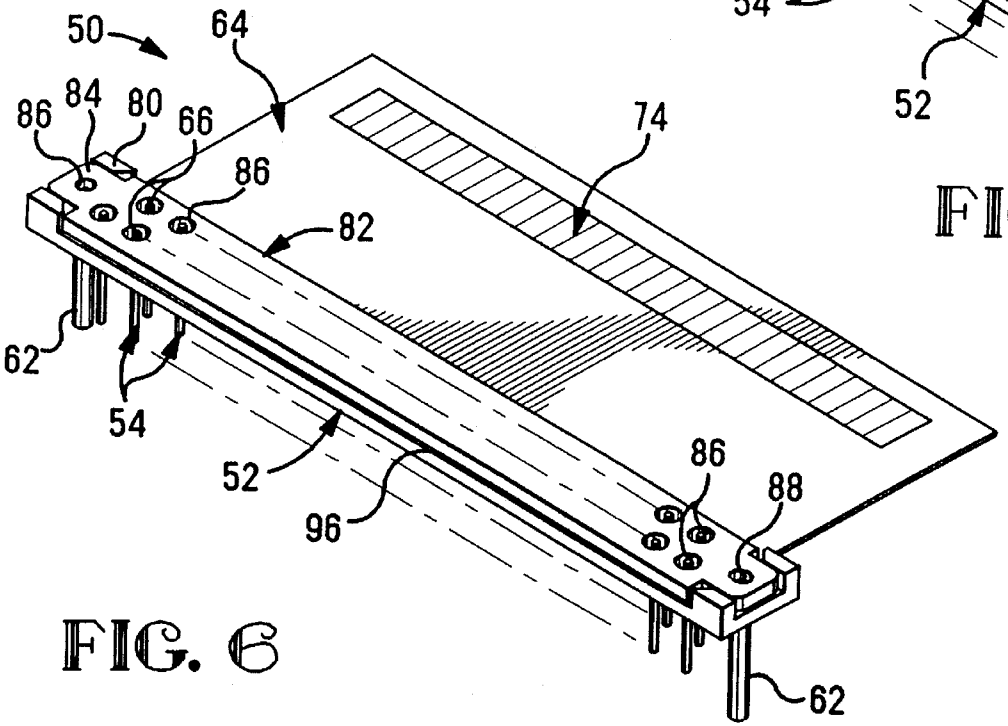

FIGS. 5 to 7 depict the assembling of connector 50. In FIG. 5, the traces of flexible circuit element 64 have been soldered to respective upper pin sections 66 of the connector extending above card-proximate face 70 of housing 52. Preferably a thin layer of potting compound 96 such as epoxy resin (or another adhesive material) may be disposed over first interconnection region 68 prior to placement of plate 82 thereover, bonding it to the flexible film element and the housing. In FIG. 6, plate 82 has been placed in position to housing 52 and flexible circuit element 64, with upper pin sections 66 and the terminations to the traces disposed in respective apertures 86 of plate 82; the apertures should be large enough to contain the entire solder joint when plate 82 is disposed against the surface of the flexible film element. In FIG. 7, apertures 86 have been filled with potting compound 98.

An alternate embodiment of the present invention is illustrated in FIG. 8. Connector 100 includes four rows of contacts 102 retained within housing 104, and flexible circuit element 106 includes traces extending from first interconnection region 108 and terminations to respective ones of the two rows of contacts thereat, to a pair of opposed second interconnection regions 110 disposed on end sections 112. End sections 112 will be disposed along opposed major surfaces of a two-sided daughter card for the exposed trace portions 114 to become terminated to the corresponding traces on the daughter card. Plate 116 includes four rows of apertures 118 corresponding to the terminations of the flexible circuit traces to the associated connector contacts 102, and the apertures 118 are filled with potting compound 120 as in FIG. 7.

The use of plates 82,116 provides enhanced strain relief protecting the terminations of the traces of the flexible circuit element to the connector contacts if stress is applied to the flexible circuit element relative to the connector. The plates also provide control over the flow of potting compound used in the prior art. Such potting compound may be for example, an epoxy resin. The housing, the organizer and the plate may all be molded for example of a thermoplastic resin such as VECTRA glass-filled LCP polyester sold by Hoechst-Celanese Corp. of Chatham, N.J. The film layers of the flexible circuit element may be adhesive-backed KAPTON polyimide film sold by E. I. DuPont de Nemours & Co. of Wilmington, Del.

Variations and modifications may occur to the specific embodiments of the invention disclosed herein, that are within the spirit of the invention and the scope of the claims.

I claim:

1. An electrical connector for interconnecting circuits of a daughter card to a mother board and being of the type including a housing and an array of contacts retained to the housing, with contact sections exposed along a board-remote surface for interconnection with respective traces of a flexible film circuit element at a first interconnection region thereof, with the traces extending to at least one second interconnection region of the flexible film circuit element for connection to corresponding traces of a daughter card, the improvement comprising:

said housing includes embossments rising from the board-remote surface at corners thereof in spaced apart pairs adjacent each end of the first interconnection region; and a plate disposed across said first interconnection region atop the board-remote face of the housing and adjacent an outwardly exposed surface of the flexible circuit element with a flange at each end of said plate disposed between a said pair of embossments of said housing, said plate including an array of apertures therethrough associated with the terminations of the traces of the flexible circuit element with the contact sections and adapted for ends of the contact sections and the joints with the traces to be disposed within the apertures, and potting compound cured within the apertures embedding and sealing the terminations.

2. An electrical connector as set forth in claim 1 wherein said plate includes apertures in each said flange for receipt thereinto of ends of guide posts of the connector.

3. An electrical connector as set forth in claim 2 wherein said apertures in said flanges contain potting compound therein embedding said ends of said guide posts.

4. An electrical connector as set forth in claim 1 wherein said plate is adhered to said housing and said flexible circuit element prior to placement of said potting compound in said apertures.

5. An electrical connector as set forth in claim 4 wherein a layer of potting compound is disposed over said first interconnection region beneath said plate.

* * * * *